US005791580A

United States Patent [19]

Anderson et al.

[11] Patent Number: 5,791,580

[45] Date of Patent: Aug. 11, 1998

[54] CORD RETRACTION DEVICE

[76] Inventors: Dennis W. Anderson, 1293 Independence Dr.; John M. Fountain, 2658 Mesquite Ave., both of Orange Park, Fla. 32065

[21] Appl. No.: 823,080

[22] Filed: Mar. 24, 1997

[51] Int. Cl.[6] ..... B65H 75/48

[52] U.S. Cl. ..... 242/378.4; 242/381.3; 24/115 A; 160/178.2

[58] Field of Search ..... 242/378.4, 381.3, 242/381.6, 378.3; 160/168.1 R, 173 R, 178.1 R, 178.2 R; 24/703.1, 703.3, 265 EC, 265 A, 115 A, 129 R

[56] References Cited

U.S. PATENT DOCUMENTS

| | | | |
|---|---|---|---|
| 1,451,300 | 4/1923 | Helman | 242/378.4 X |
| 1,975,864 | 10/1934 | Plasters | 24/115 A X |
| 2,137,814 | 11/1938 | Skora | 24/265 A X |
| 2,526,256 | 10/1950 | Mihara | 242/381.3 |
| 2,926,865 | 3/1960 | Humphreys | 242/381.6 X |
| 4,271,893 | 6/1981 | McCluskey | 160/178.1 R |
| 4,765,557 | 8/1988 | Kahmann | 242/381.6 |
| 5,114,091 | 5/1992 | Peterson et al. | 242/378.3 |
| 5,279,473 | 1/1994 | Rozon | 160/178.1 R X |
| 5,553,650 | 9/1996 | Jelic | 160/178.1 R |
| 5,553,653 | 9/1996 | Rozon | 160/173 R |
| 5,630,456 | 5/1997 | Hugo et al. | 160/173 R |

*Primary Examiner*—Donald P. Walsh
*Assistant Examiner*—William A. Rivera
*Attorney, Agent, or Firm*—Thomas C. Saitta

[57] ABSTRACT

A cord retraction device for drawing excess cord lengths into a housing through a cord aperture, the housing, containing a rotating spool driven by a coiled spring, the cord being attached to the spool through a lead member and cord retention member, where the cord retention member has an open, non-attached configuration of greater dimensions than the cord aperture, and where the lead member is of sufficient length such that the cord retention member is positioned outside the housing when the coiled spring is fully wound, such that the cord retention member Can only pass through the cord aperture after it is joined to the cord in a closed, attached configuration of dimensions smaller than the cord aperture. An embodiment with oppositely rotating spools for use with looped cords is also presented.

14 Claims, 2 Drawing Sheets

CORD RETRACTION DEVICE

BACKGROUND OF THE INVENTION

This invention relates generally to devices which retract and house excess cord or string lengths, such as found on window blinds or the like, for either safety or aesthetic reasons. More particularly, the invention relates to such retraction devices where the excess string is automatically retracted onto a spring-wound spool within a housing, the device remaining locked in position unless a release means is actuated to allow spool movement. Even more particularly, the invention relates to such devices having an open cord retention member attached to a pre-tensioned coiled spring, where the cord retention member cannot pass through the cord aperture in the open configuration, but will be pulled into the housing along with the cord when the cord retention member is in the closed position affixed to the cord.

Window blinds and similar devices use one or multiple cords to operate and manipulate the blinds, such as for changing the slant of the blinds or raising or lowering the bottom member to vary the amount of window coverage. The cords hanging from the window blinds are unsightly, and more significantly, pose a safety hazard to infants, small children and pets. A child or animal may become entangled in the cords and if not rescued in time can be strangled. Devices addressing this hazard have been developed, but all suffer from one or more drawbacks. For example, U.S. Pat. No. 4,909,298 to Langhart et al. shows a safety device comprising two members designed to break apart when a force is applied between them. The drawback to this device is that the cords still hang the full exposed length and the safety element relies on the separation of the members. If the cord were to be looped multiple times around a child's neck, the force required to split the members may not be present. Other devices, more closely related to this invention, involve housings which allow for automatic retraction of the cords. The cords are retracted into the device such that the device hangs a good distance from the floor. Such devices are shown in U.S. Pat. No. 4,271,893 to McCluskey and U.S. Pat. No. 5,279,473 to Rozon. A drawback to these devices is that the consumer must disassemble the housings to properly attach the cords, meaning that the devices must be designed in complicated manner to assure that the consumer can properly utilize the device.

It is an object of this invention to provide a safety device which automatically retracts the cords into a housing where the consumer can easily attach the cord or cords to the device without the need to disassemble the housing. It is a further object to provide such a device having a spool driven by a coiled spring which has a cord retention member which is positioned external to the housing when the spring is fully pre-tensioned, with the cord retention member having dimensions greater than the cord aperture into the housing in the open or non-attached configuration, the cord retention member being able to be reconfigured or shaped upon attachment to the cord into a closed configuration of dimensions smaller than the cord aperture, thus allowing the consumer to attach the cord and then cause it to be retracted into the housing. It is a further object to provide such a device which incorporates two oppositely rotating spools for use with looped cords.

SUMMARY OF THE INVENTION

The invention comprises in general a housing with a cord aperture to receive and allow passage of one or more cords or strings hanging from window blinds or the like, the housing containing a rotating spool member for taking up a length of the cord in a winding manner. The spool is rotated in one direction by the release of stored energy in a coiled spring for retraction of cord into the housing, one end of the spring being affixed to a central axis and the other affixed to the internal wall of the rotating spool member. The spool is rotated in the other direction for withdrawal of cord from the housing by pulling on external portions of the cord while the housing is held stationary or by pulling down on the housing. A release member, such as a spring-biased lock which brakes against the spool or the cord, must be actuated for movement of the spool, the spool being locked against rotation in the passive state.

The cord is attached to the spool by a cord retention member and a connecting lead member, which may be a string, cord or strip of flexible material such as plastic or the like, one end of the lead member being affixed to the exterior circumference of the spool. The cord retention member is connected to the free end of the lead member. The lead member is of sufficient length such that, with the spool and coiled spring in the fully wound or tensioned positioned, the cord retention member is positioned external to housing. The cord retention member is constructed to have an open, pre-attachment, configuration of sufficient dimension relative to the cord aperture in the housing that the cord retention member cannot be pulled through the cord aperture when the cord retention member is in the open configuration. The cord retention member thus acts as a detent against the stored energy in the spring, preventing the spring from uncoiling. The cord retention member is constructed to be reconfigured into a configuration of smaller dimensions when the cord retention member is attached to the cord end, such that the closed, attached configuration will fit through the cord aperture. In this manner, once the cord retention member is attached to the cord, the spring will pull the cord retention member and the cord into the housing to be wound onto the spool. The spool may be provided with a lead member slot or recess which allows the lead member and cord retention member to occupy a recessed position to insure that the cord retention member will not tangle with successive windings of the cord.

For applications where the window blinds or like apparatus has a pair of cords forming a loop, where the parallel cord portions need to be moved in opposite directions to manipulate the blinds, the device is constructed with a pair of oppositely rotating spools within the housing, each spool being independently rotated by its own oppositely wound coiled spring. Each coil also has its own lead member and cord retention member, both the cord retention members being positioned external to the housing and restricted from passing through the cord aperture in the open configuration until each is attached to a cord end, created by cutting the cord loop.

DETAILED DESCRIPTION OF THE INVENTION

Figure 2:
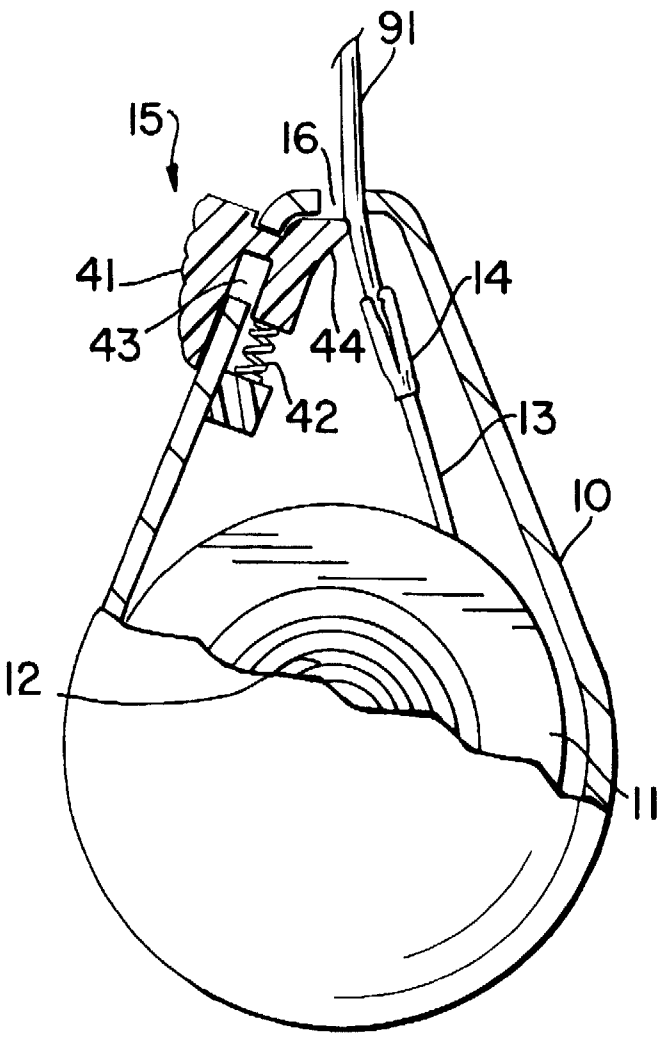
FIG. 2 is an exposed side view similar to FIG. 1, showing the cord retention member in the closed configuration, attached to a cord, and as retracted through the cord aperture into the housing. An alternative spool release means is also shown.
Figure 1:
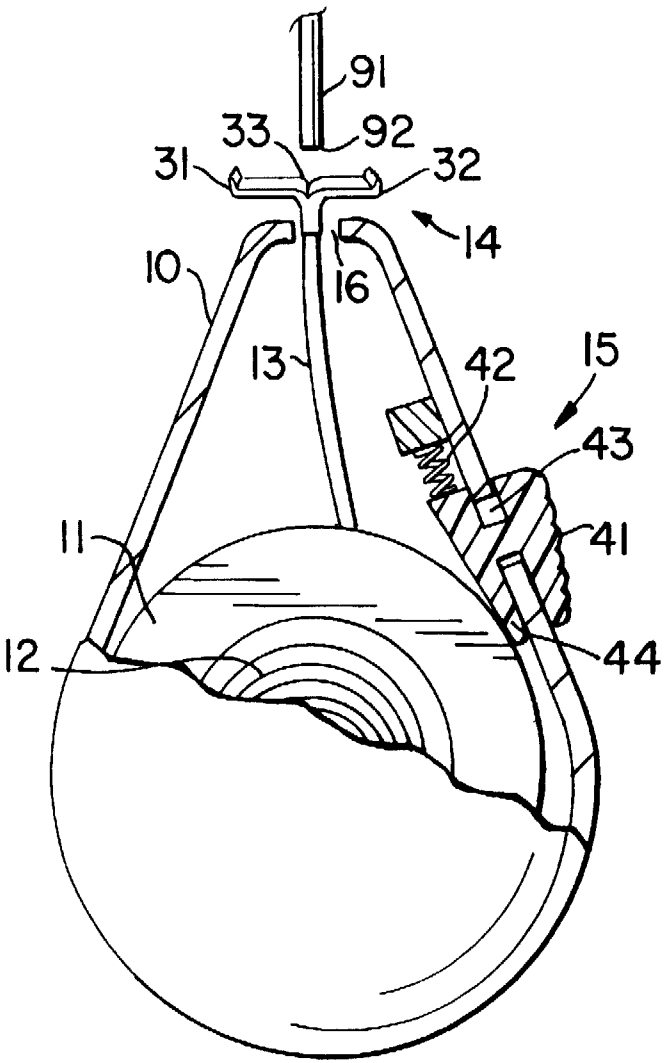
FIG. 1 is an exposed side view of the invention, showing the cord retention member in the open configuration external to the housing.
Figure 3:
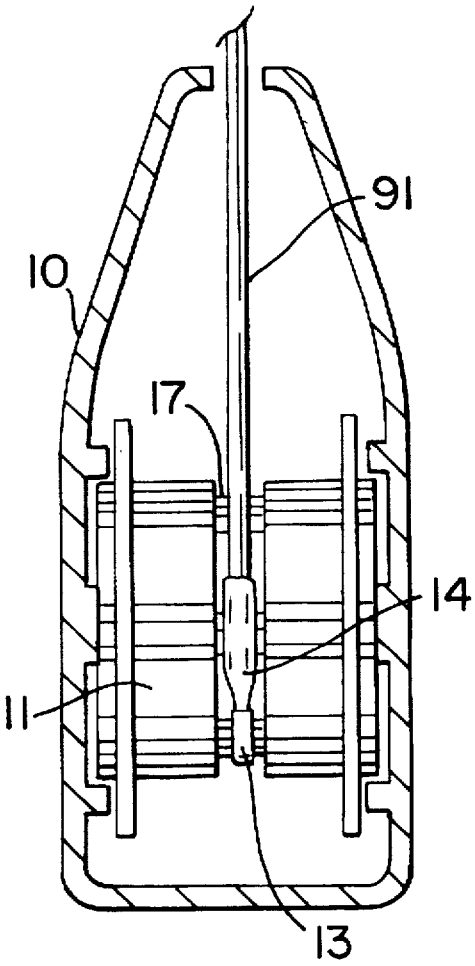
FIG. 3 is a cut-away side view showing the lead member and cord retention member wound onto the spool and positioned in the lead recess.
Figure 4:
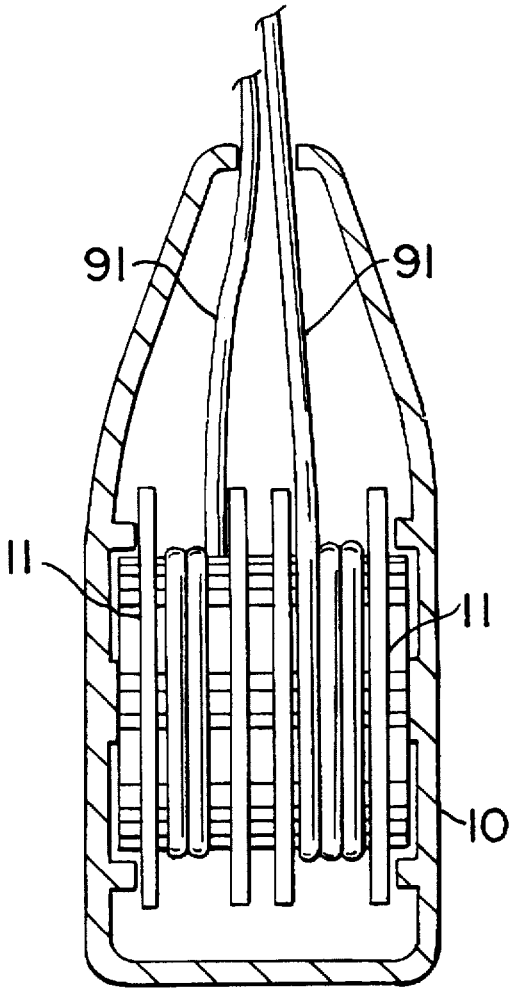
FIG. 4 is a cut-away side view of an embodiment of the invention for use with a cord loop, showing the pair of spools which rotate in opposite direction.

With reference to the figures, the invention will now be described in detail with regard to the best mode and the preferred embodiment. FIGS. 1 through 3 illustrate the device for use with a single cord or multiple cords which do not have separate relative movement, all the cords moving in conjunction. FIG. 4 illustrates the embodiment of the device for use with a looped cord, where the parallel portions of the cord move in relative opposite directions. The invention is designed for use with window blind cords and serves the purpose of providing a housing to retain excess lengths of cord which are retracted into the device, such that the device can be positioned at an elevated height out of the reach of infants, children and pets, even when the cords are in the fully extended position to fully raise the window blinds. At the same time, the device provides a more aesthetic look to the room, since there are no long dangling cords hanging down the wall.

With reference now to FIGS. 1 and 2, the device is seen to comprise a housing 10 with an interior to receive the working components. Housing 10 is preferably made of a molded plastic in a generally rounded or oblong shape, but other shapes are possible and other suitable materials may also be used. Housing 10 contains a rotating spool 11 which is used to take-up lengths of cord 91 in a winding manner. The rotating spool 11 is driven by a coiled or helical spring 12, the spring 12 having one end fixed to a stationary axle of housing 10 and the other connected to the interior wall of spring 12, such that rotating the spool in one direction tightens or pre-tensions the spring 12, creating stored energy which causes the spool 11 to rotate in the opposite direction when released. This combination of housing 10, spool 11 and spring 12 is well known in what are called automatic retracting devices.

The device is provided with a lead member 13, which comprises a short length of cord, string or a thin, flexible strip of plastic or the like. The lead member 13 has one end affixed to the exterior circumferential wall of spool 11. The other end of lead member 13 has a cord retention member 14 attached thereto. The length of lead member 13 is at least sufficient so that cord retention member 14 is positioned outside of housing 10, the cord retention member 14 or a portion of the lead member 13 extending through cord aperture 16, which is the opening in housing 11 for receipt and passage of cord or cords 91. Cord retention member 14 comprises any suitable means for securely retaining a cord end 92 and connecting cord 91 to lead member 13. In the preferred embodiment, cord retention member 14 can be shaped or reconfigured from an open, non-attached configuration, as shown in FIG. 1, to a closed, attached configuration as shown in FIG. 2. The open configuration of cord retention member 14 has dimensions greater than the cord aperture 16, such that cord retention member 14 cannot pass through the cord aperture 16 in the open configuration. During manufacture, cord retention member 14 and lead member 13 are attached to the spool 11 with the coiled spring 12 fully wound or tightened and with cord retention member 14 positioned outside the housing 10. In this manner, spring 12 has its maximum stored energy and will upon release rotate spool 11 the maximum number of possible rotations when in the circumstances illustrated in FIG. 1.

Cord retention member 14 preferably comprises a pair of first and second opposing jaws 31 and 32 joined by a flexible hinge 33, all composed of a malleable metal. In the open configuration, as shown in FIG. 1, the outer dimensions of the two jaws 31 and 32 exceed the dimensions of cord aperture 16, i.e., the cord retention member 14 in the open configuration is larger than the cord aperture 16, and therefore the cord retention member 14 cannot be pulled into housing 11 by the stored energy of fully pre-tensioned spring 12. To join the cord end 92 to the lead member 13, the jaws 31 and 32 of cord retention member 14 are folded or crimped together to clinch the cord 91. Jaws 31 and 32 may be provided with teeth or other structures to better grip cord 91, and can be designed with the hinge 33 running in the cord axial direction so that the jaws 31 and 32 grasp the cord 91 longitudinally. When the cord retention member 14 has been attached to the cord 91, its closed configuration is smaller in dimension than the cord aperture 16. Thus when release means 15 is actuated to allow free rotation of spool 11, the stored energy in spring 12 will retract the lead member 13, the cord retention member 14 and the cord 91 into housing 10 and around spool 11 the desired number of rotations. When the desired length of cord 91 has been retracted into housing 10, the release means 15 is released to brake and stop the rotation. Release means 15 may comprise any suitable braking mechanism to prevent rotation of spool 11 unless actuated, and may comprise an actuator button 41 external to the housing 11 which is positionable by pressing or sliding, the actuator 41 being connected through slot 43 to a brake member 44. The release means 15 locks rotation in the passive or non-actuated condition, the brake member 44 being maintained in position by the force of a brake spring 42. As shown in FIG. 1, the brake member 44 may abut the spool 11 directly, or as shown in FIG. 2, the brake member 44 may abut the cord 91.

Referring now to FIG. 3, a preferred embodiment for spool 11 is shown. Here the outer circumference of spool 11 is provided with a lead recess or slot 17, such that when the lead member 13 and cord retention member 14 are wound onto the spool 11 they will be positioned in lead recess 17. This prevents entanglement of the lead member 13 and in particular the cord retention member 14 with successive windings of cord 91.

In circumstances with multiple cords 91, the embodiment shown in FIGS. 1 through 3 can be used if the multiple cords 91 do not move independently relative to each other. For circumstances where parallel cords 91 or cord segments are required to move in opposite directions to manipulate the window blinds in a certain manner, such as with a looped cord 91, the embodiment shown in FIG. 4 is used. This embodiment shows the device with a pair of independent first and second spools 11 mounted within housing 10. Each spool 11 is driven by its own coiled spring 12, in the manner explained above, but the first and second springs 12 are wound in opposite directions such that the spools 11 will rotate in opposite directions. The stored energy of first spring 12 will cause first spool 11 to rotate clockwise, while the stored energy of the second spring 12 will cause the second spool 11 to rotate counter-clockwise. Separate first and second lead members 13 and first and second cord retention members 14 are attached to each spool 11 as set forth above, and each cord retention member 14 is positioned external to the cord aperture 16 in the non-attached configuration, with the coiled springs 12 both fully tensioned. To attach a looped cord 91, the cord 91 is cut at the bottom to create two cord ends 92. Each cord end 92 is connected to one cord retention member 14. As before, the closed configuration cord retention members 14 and attached cords 91 can now be drawn into the housing 11 and wound around spool 11. To manipulate the window blinds by opposite movement of the two cords 91, the release means 15 is actuated to allow rotation of spools 11. A length of the appropriate cord 91 is pulled from the window blind apparatus and the slack in this cord 91 is automatically retracted into the housing 11 by the stored energy of the coiled spring 12 connected to one spool 11. At the same time, since the other spool 11 is free to rotate, the other cord 91 will be drawn from the housing 11 at the same rate, since the first cord 91 being pulled is connected through the window blind apparatus to the second cord 91. As the cord 91 is pulled from the housing, that spool 11 rotates and re-tensions the spring 12 connected to that spool 11, creating more stored energy for use when that cord 91 needs to be retracted into the housing.

Figure 5:
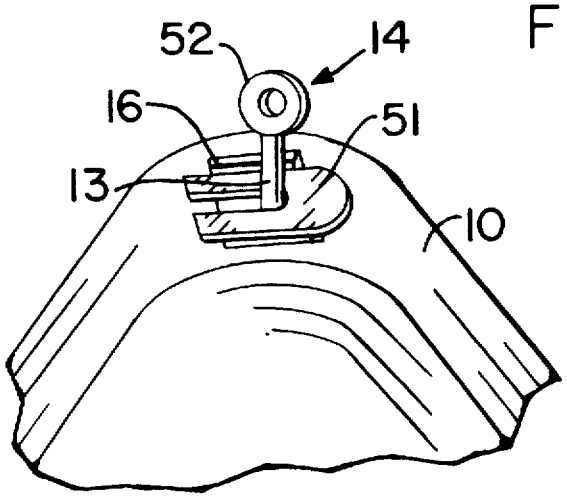
FIG. 5 is a partial view of alternative cord retention member with a removable stop member to prevent retraction into the housing.

In a less preferred alternative embodiment, the device may comprise a cord retention member 14 which has a removable stop member 51, as shown in FIG. 5. In this embodiment, the non-attached configuration of the cord retention member 14 with dimensions greater than the cord aperture 16 is formed by the combination of the removable stop member 51, whose dimensions are greater than the cord aperture 16, and a small dimension attachment member 52, which can be a set of jaws as described before, a loop, or any other suitable means for connecting the lead member 13 to the cord end 92. Removal of stop member 51 creates the attached configuration of small total dimension which allows the cord 91 to be drawn into the housing 11.

It is understood that equivalents and substitutions for certain elements described above may be obvious to those skilled in the art. The true scope and definition of the invention therefore is to be as set forth in the following claims.

We claim:

1. A cord retraction device comprising a housing having a cord aperture, a rotating spool, a coiled spring which rotates said spool, a lead member attached to said spool, and a cord retention member connected to said lead member for attachment of a cord, where said cord retention member has an open configuration and a closed configuration, said cord retention member being positioned external to said housing in said open configuration and said cord retention member in said open configuration being larger than said cord aperture whereby said cord retention member cannot be drawn through said cord aperture, and where said cord retention member is reconfigured into said closed configuration for attachment of a cord and said cord retention member in said closed configuration being smaller than said cord aperture whereby said cord retention member can be drawn through said cord aperture into said housing.

2. The device of claim 1, where said coiled spring is fully tensioned when said cord retention member is positioned external to said housing in said open configuration.

3. The device of claim 1, where said cord retention member comprises a pair of opposing jaws made of malleable metal.

4. The device of claim 1, further comprising release means for preventing rotation of said spool unless said release means is actuated.

5. The device of claim 4, where said release means comprises a spring-biased brake member.

6. The device of claim 1, further comprising a lead recess on said spool to receive said lead member and said cord retention member.

7. The device of claim 1, where said spool is a first spool, said spring is a first spring which rotates said first spool, said lead member is a first lead member and said cord retention member is a first cord retention member, the device further comprising a second spool, a second coiled spring which rotates said second spool, a second lead member attached to said second spool, and a second cord retention member connected to said a second lead member for attachment of a second cord, said second spool rotating independently of said first spool and said second spring being mounted oppositely to said first spring such that rotation of said first spool by said first spring is in the opposite direction from rotation of said second spool by said second spring.

8. The device of claim 7, where each said first and second coiled spring is fully tensioned when each said first and second cord retention member is positioned external to said housing in said open configuration.

9. The device of claim 7, where each said first and second cord retention member comprises a pair of opposing jaws made of malleable metal.

10. The device of claim 7, further comprising release means which prevents rotation of said first and second spools unless said release means is actuated.

11. The device of claim 10, where said release means comprises a spring-biased brake member.

12. The device of claim 7, further comprising a lead recess on each said first spool and said second spool to receive each said first and second lead member and each said first and second cord retention member.

13. A method of attaching a cord to a retracting spool device, comprising the steps of providing a retracting spool device comprising a housing having a cord aperture, a rotating spool, a fully tensioned coiled spring which rotates said spool, a release means to prevent rotation of said spool unless said release means is actuated, a lead member attached to said spool, and a cord retention member connected to said lead member for attachment of a cord, where said cord retention member is positioned external to said housing in an open configuration, said cord retention member in said open configuration being larger than said cord aperture whereby said cord retention member cannot be drawn through said cord aperture, attaching a cord to said cord retention member by reconfiguring said cord retention member into a closed configuration, said cord retention member in said closed configuration being smaller than said cord aperture whereby said cord retention member can be drawn through said cord aperture into said housing by actuating said release means to allow said coiled spring to rotate said spool.

14. The method of claim 13, where said spool is a first spool, said spring is a first spring, said lead member is a first lead member and said cord retention member is a first cord retention member, further comprising the steps of providing within said housing a second rotating spool, a second fully tensioned coiled spring which rotates said second spool in a direction opposite to the rotation of said first spool, a second lead member attached to said second spool and a second cord retention member connected to said second lead member, a release means to prevent rotation of said second spool unless said release means is actuated, where said second cord retention member is positioned external to said housing in an open configuration, said a second cord retention member in said open configuration being larger than said cord aperture whereby said second cord retention member cannot be drawn through said cord aperture, attaching another cord to said second cord retention member by reconfiguring said second cord retention member into a closed configuration, said second cord retention member in said closed configuration being smaller than said cord aperture whereby said second cord retention member can be drawn through said cord aperture into said housing by actuating said release means to allow said second coiled spring to rotate said second spool.

* * * * *